US005520560A

United States Patent [19]

Schiabel et al.

[11] Patent Number: 5,520,560

[45] Date of Patent: May 28, 1996

[54] COMBINATION OF MATERIALS FOR MERCURY-DISPENSING DEVICES, METHOD OF PREPARATION AND DEVICES THUS OBTAINED

[75] Inventors: Antonio Schiabel, Garbagnate; Claudio Boffito, Rho, both of Italy

[73] Assignee: Saes Getters S.p.A., Milan, Italy

[21] Appl. No.: 393,543

[22] Filed: Feb. 23, 1995

[30] Foreign Application Priority Data

Feb. 24, 1994 [IT] Italy ..... MI94A0341

[51] Int. Cl.[6] ..... H01J 9/395

[52] U.S. Cl. ..... 445/9; 252/181.3

[58] Field of Search ..... 445/9, 19; 252/181.3

[56] References Cited

U.S. PATENT DOCUMENTS

| | | | |
|---|---|---|---|
| 3,318,649 | 5/1967 | Keller, Jr. et al. | 445/9 |
| 3,722,976 | 3/1973 | Porta et al. | 445/9 |
| 3,733,194 | 5/1973 | Della Porta et al. | 75/0.5 |
| 4,105,910 | 8/1978 | Evans | 313/490 |
| 4,464,133 | 8/1984 | Buhrer | 445/9 |

FOREIGN PATENT DOCUMENTS

| | | | |
|---|---|---|---|
| 0091297 | 10/1983 | European Pat. Off. | 7/18 |
| 0307037 | 3/1989 | European Pat. Off. | 61/28 |
| 201360 | 11/1984 | Japan . | |

*Primary Examiner*—Kenneth J. Ramsey
*Attorney, Agent, or Firm*—Hickman Beyer & Weaver

[57] ABSTRACT

A mercury-dispensing combination suitable to release an amount of mercury higher than 60% during the activation step, even after partial oxidation, includes a mercury-dispensing intermetallic compound A with Hg and a second metal selected among Ti, Zr and mixtures thereof, as well as a promoting alloy or intermetallic compound B including Cu and a second metal selected among Sn, In or Ag or combinations thereof. There is also disclosed a mercury-dispensing device containing a combination of materials A and B, in addition to a process for introducing mercury into electron tubes consisting in the introduction of one of said devices inside the open tube and then heating thereof at a temperature between 550° and 900° C. after the tube sealing in order to get Hg free.

24 Claims, 2 Drawing Sheets

Fig. 1
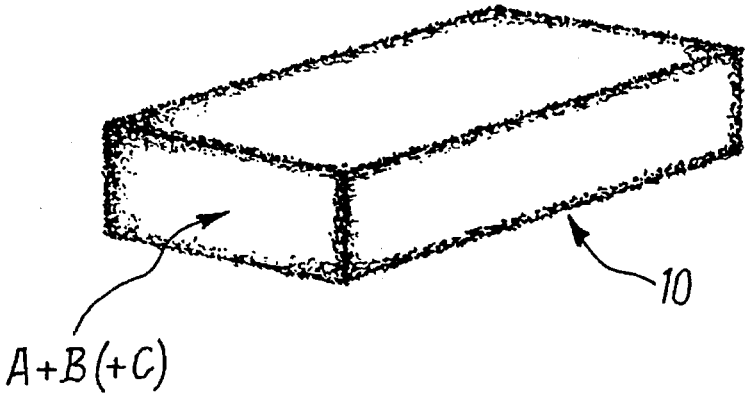
Fig. 2
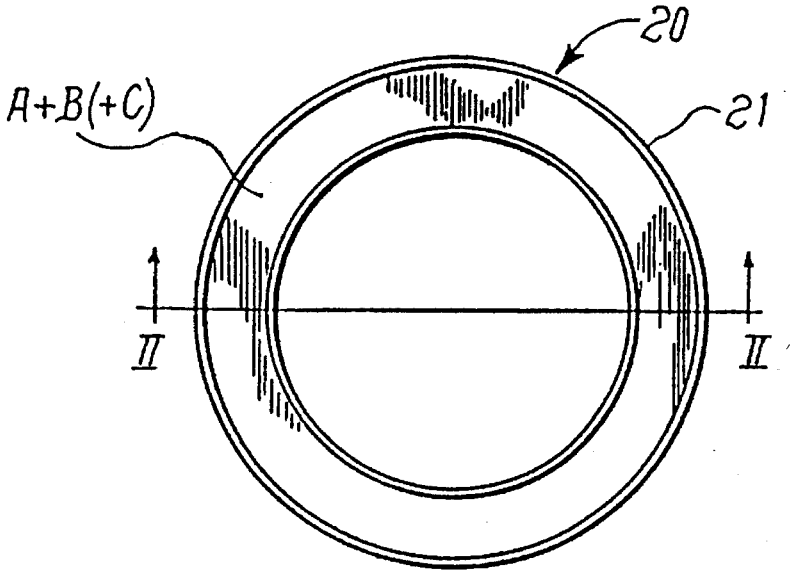
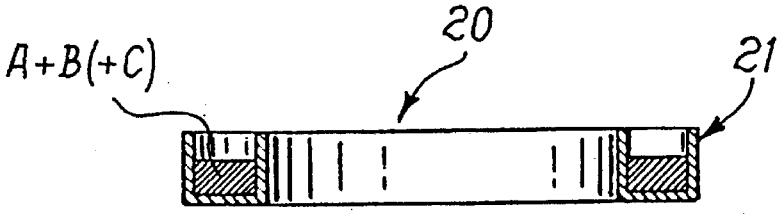
Fig. 2a

COMBINATION OF MATERIALS FOR MERCURY-DISPENSING DEVICES, METHOD OF PREPARATION AND DEVICES THUS OBTAINED

This application claims the priority of Italian Patent Application No. MI94 A 000341, filed Feb. 24, 1994, which is incorporated herein by reference.

BACKGROUND OF THE INVENTION

The present invention relates to a combination of materials for the production of mercury-dispensing devices, to the mercury-dispensing devices thus produced and to a process for the introduction of mercury inside electron tubes.

The use of small amounts of mercury in electron tubes such as, for example, mercury-arc rectifiers, lasers, various kinds of alphanumeric displays and, particularly, fluorescent lamps is well known in the art.

A precise dosage of mercury inside these devices is extremely important for the quality of the devices and most of all for ecological reasons. In fact, the high toxicity of this element implies serious problems of ecological nature upon end-life disposal of the devices containing it, or in case of accidental break-up of the devices. These problems of ecological nature impose the use of amounts of mercury as small as possible, compatibly with the functionality of the tubes. These considerations have been lately included also in the legislative sphere, and the trend of the recent international regulations is to establish upper limits for the amount of mercury which can be introduced into the devices: for example, for standard fluorescent lamps the use of a total amount of mercury (Hg) not greater than 10 milligram (mg) per lamp has been suggested.

In the past mercury was introduced into the tubes in liquid form. However, the use of liquid mercury poses problems concerning the storing and handling in the plants for the production of tubes, due to its high vapor pressure also at room temperature. Secondly, a common drawback of the techniques for the introduction of mercury into the tubes in liquid form is the difficulty in precisely and reproducibly dosing volumes of mercury on the order of microliters, which difficulty usually leads to the introduction of amounts of the element in amount much higher than needed.

These drawbacks have lead to the development of various alternatives to the use of liquid mercury in free form.

The use of liquid mercury contained in capsules is disclosed in several documents. This method is described, for example, in U.S. Pat. Nos. 4,823,047 and 4,754.193, referring to the use of metallic capsules, and in U.S. Pat. Nos. 4,182,971 and 4,278,908 wherein the mercury container is made of glass. After closing the tube, the mercury is released by means of a heat treatment which causes the breakage of the container. These methods generally have some drawbacks. First of all, the production of the capsules and their mounting inside the tubes may be complicated, especially when they have to be introduced inside small-size tubes. Secondly, the breakage of the capsule, particularly if it is made of glass, may produce fragments of material which can jeopardize the tube quality, so much so that U.S. Pat. No. 4,335326 discloses an assembly wherein the mercury-containing capsule is in turn located inside a capsule acting as a shield for the fragments. Moreover, the release of the mercury is often violent, with possible damages to the inner structure of the tube. Finally, these systems still have the drawback of employing liquid mercury, and therefore they do not completely solve the problem of the precise and reproducible dosage of few milligrams of mercury.

U.S. Pat. No. 4,808,136 and the European patent application EP-568,317 disclose the use of tablets or small spheres of porous material soaked with mercury which is released by heating. However, these methods also require complicated operations for the loading of mercury into the tablets, and the released amount of mercury is difficult to reproduce.

These problems are overcome by U.S. Pat. No. 3,657,589 assignee of the present invention, which discloses the use of intermetallic compounds of mercury having the general formula $Ti_xZr_yHg_z$, wherein x and y may vary between 0 and 13, the sum (x+y) may vary between 3 and 13 and z may be 1 or 2.

These compounds have a temperature of mercury-release start variable according to the specific compound, however they are all stable up to about 500° C. both in the atmosphere and in evacuated volumes, thus being compatible with the operations for the assembly of the electron tubes, during which the mercury-dispensing devices may reach temperatures of about 400° C. After closing the tube, the mercury is released from the above-cited compounds by an activation operation, which is usually carried out by heating the material between 750° C. and 900° C. for about 30 seconds. This heating may be accomplished by laser radiation, or by induction heating of the metallic support of the Hg-dispensing compound. The use of the $Ti_3Hg$ compound, manufactured and sold by the assignee of two present invention under the trade name St505 is particularly advantageous; in particular, the St505 compound in sold in the form of compressed powder in a ring-shaped container or of compressed powder in pills or tablets, under the trademark "STAHGSORB", or in the form of powders laminated on a metallic strip, under the trademark "GEMEDIS".

These materials offer various advantages with respect to the prior art:

- as mentioned above, they avoid the risks of mercury evaporation during the cycle of production of the tubes, in which temperatures of about 350°–400° C. may be reached;
- as described in the cited U.S. Pat. No. 3,657,589, a getter material can be easily added to the mercury-dispensing compound with the purpose of chemisorption of gases such as CO, $CO_2$, $O_2$, $H_2$and $H_2O$, which would interfere with the tube operation; the getter being activated during the same heat treatment for the release of mercury;
- the released amount of mercury is easily controllable and reproducible.

Despite their good chemical-physical characteristics and their great ease of use, these materials have the drawback that the contained mercury is not completely released during the activation treatment. In fact, the processes for the production of mercury-containing electron tubes include a tube-closing operation performed by glass fusion (e.g. the sealing of fluorescent lamps) or by frit sealing, i.e. welding two pre-shaped glass members by means of a paste of low-melting glass. During these operations, the mercury-dispensing device may undergo an indirect heating up to about 350°–400° C.; in this step the device is exposed to gases and vapours emitted by the melted glass and, in almost all industrial processes, to air. In these conditions, the mercury-dispensing material undergoes a surface oxidation, whose final result is a yield of about 40% of the total mercury content during the activation process.

The mercury not released during the activation operation is then slowly released during the life of the electron tube.

This characteristic, together with the fact that the tube must obviously work from the beginning of its life cycle, leads to the necessity of introducing into the device an amount of mercury which is about double than that which would theoretically be necessary.

In order to overcome these problems, patent application EP-A-091,297 suggests the addition of Ni or Cu powders to the $Ti_3Hg$ or $Zr_3Hg$ compounds. According to this document, the addition of Ni and Cu to the mercury-dispensing compounds causes the melting of the combination of materials thus obtained, favouring the release of almost all the mercury in few seconds. The melting takes place at the eutectic temperatures of the systems Ni—Ti, Ni—Zr, Cu—Ti and Cu—Zr, ranging from about 880° C. for the Cu 66%–Ti 34% composition to 1280° C. for the Ni81%–Ti 19% composition (atomic percent), though the document erroneously gives a melting temperature of 770° C. for the Ni 4%–Ti 96% composition. The document acknowledges that the mercury-containing compound is altered during the tube working treatments, and it needs a protection; to this purpose, there is suggested to close the powder container by means of a steel, copper or nickel sheet which is broken during the activation by the pressure of the mercury vapor generated inside the container. This solution is not completely satisfactory: in fact, as in the methods employing capsules, the mercury bursts out violently and can cause damages to portions of the tube. In addition, the manufacturing of the container is quite complicated, since it requires the welding of small-size metallic members. Furthermore, this document does not contain experimental data to support the assessed good mercury-release characteristics of the combinations indicated.

SUMMARY OF THE INVENTION

Therefore, an object of the present invention is to provide an improved combination of materials for dispensing mercury in electron tubes, which allows to overcome one or more drawbacks of present materials and method.

In particular, an object of the present invention is to provide an improved combination of materials for dispensing mercury capable of releasing amounts of mercury higher than 60% during the activation step, even after partial oxidation, so as to be able to reduce the total amount of employed mercury.

Another object of the present invention is to provide mercury-dispensing devices containing the combination of materials of the invention.

Still another object is to provide a process for introducing mercury by means of the devices of the invention into the electron tubes which require said element.

According to the present invention, these and other objects are achieved by using a mercury-dispensing combination of materials made up of:

- a mercury-dispensing intermetallic compound A including mercury and a second metal selected among titanium, zirconium and mixtures thereof;
- an alloy or an intermetallic compound B including copper, a second metal selected among tin, indium, silver or combinations thereof, and possibly a third metal selected among the transition elements.

BRIEF DESCRIPTION OF THE DRAWINGS

Further objects and advantages of the present invention will be apparent from the following detailed description referring to the annexed drawings wherein:

FIG. 1 is a perspective view of a mercury-dispensing device of the present invention according to a possible embodiment thereof;

FIG. 2 and 2*a* are, respectively, a top plan view and a sectional view along II—II of a device of the invention according to another possible embodiment;

DETAILED DESCRIPTION OF THE PREFERRED EMBODIMENTS

Figure 3:
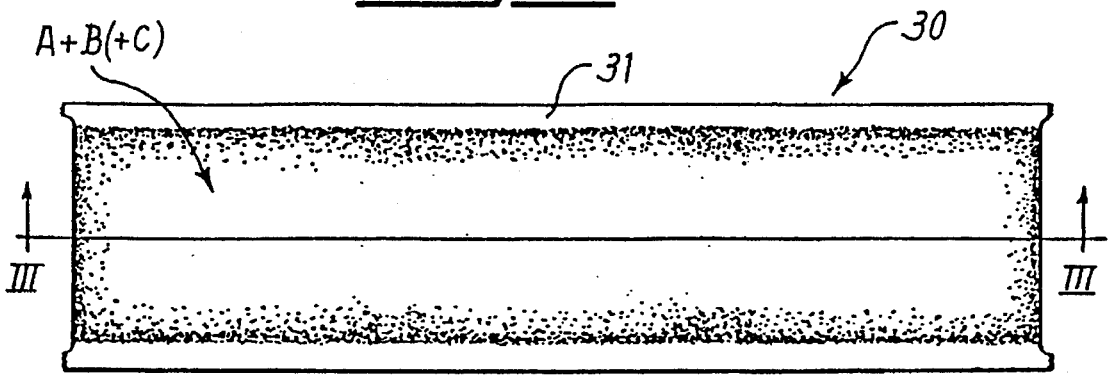
FIG. 3, 3*a* and 3*b* are, respectively, a top plan view and two sectional views along III—III of a device of the invention according to a further embodiment, in two possible variations.

Component A of the combination of the present invention, hereafter also defined as a mercury dispenser, is an intermetallic compound corresponding to formula $Ti_xZr_yHg_z$, as disclosed in the cited U.S. Pat. No. 3,657,589, which is incorporated herein by reference. Among the materials corresponding to said formula, $Zr_3Hg$ and, particularly, $Ti_3Hg$ are preferred.

Component B of the combination of the present invention has the function of favouring the release of mercury from component A, and hereafter will be defined as a "promoter". This component is an alloy or an intermetallic compound including copper, a second metal selected among tin, indium silver or combinations thereof, and possibly a third metal selected among the transition elements.

The atomic ratios between the elements of the binary or ternary compositions making up component B of the combinations of the present invention vary according to the constituent elements.

In the case of binary alloys of copper with tin or indium, the optimum ranges are the following:

Cu—Sn: from about 3% to about 63% of copper on a weight basis

Cu—In: from about 40% to about 60% of copper on a weight basis

It is also possible to use alloys of three or more metals obtained from the preceding ones by adding an element selected among the transition metals in an amount not greater than about 10% of the overall weight of component B.

In the case of Cu—Ag binary alloys, the ratio between the two components may range from about 10% to about 80% of Cu on a weight basis, and preferably between about 20% and about 50% of Cu on a weight basis.

Among the above-mentioned compositions, those including Sn—Cu are particularly preferred for their case of preparation and good mechanical characteristics. More preferred is a composition containing between about 54.5% to 56.5% (atomic percent) of copper, corresponding to the non-stoichiometric compound $Cu_6Sn_5$.

The weight ratio between components A and B of the combination of the invention may vary within a wide range, but it is generally included between about 20:1 and 1:20, and preferably between about 10:1 and about 1:5 .

Components A and B of the combination of the invention may be employed in various physical forms, not necessarily the same for the two components. For example, component B may be present in the form of a coating of the metallic support, and component A as a powder adhered to component B by rolling. However, in a preferred embodiments both components are in the form of a fine powder, having a particle size lower than about 250 μm and preferably between about 10 and about 125 μm.

The present invention, in a second aspect thereof, relates to the mercury-dispensing devices which use the above-described combinations of A and B materials.

As previously mentioned, one of the advantages of the materials of the invention with respect to prior art systems is that they do not need mechanical protection from the environment, Consequently, the mercury-dispensing devices of the present invention can be manufactured in a variety of geometric shapes, and materials A and B of the combination can be employed without support or on a support, usually metallic.

Some classes of electron tubes for which the mercury dispensers of the invention are intended further require, for their correct operation, the presence of a getter material C which removes traces of gases such as CO, $CO_2$, $H_2$, $O_2$ or water vapor: for example, in fluorescent lamps. For these applications, the getter can be advantageously introduced by means of the same mercury-dispensing device, according to the manners described in the cited U.S. Pat. No. 3,657,589.

Examples of getter materials include, among the others, metals such as titanium, zirconium, tantalum, niobium, vanadium and mixtures thereof, or alloys thereof with other metals such as nickel, iron, and aluminum. A preferred getter material is an alloy having a weight percentage composition Zr 84%–Al 16%, manufactured by SAES Gotters, s.p.a (Milan Italy) under the name St101, or the intermetallic compounds $Zr_2Fe$ and $Zr_2Ni$, manufactured by the same entity under the tradename St198 and St199. Respectively. The getter is activated during the same heat treatment by which mercury is released inside the tube.

The getter material C may be present in various physical forms, but it is preferably employed in the form of a fine powder, having a particle size lower than about 250 μm and preferably between about 10 μand about 125 μm.

The ratio between the overall weight of the A and B materials and that of the getter material C may generally range from about 10:1 to about1:10, and preferably between about 5:1 and 1:2.

Some possible embodiments of the devices of the invention are illustrated hereunder With reference to the drawings.

In a first possible embodiment, the devices of the invention can simply consist of a tablet 10 made up of compressed and, unsupported powders of the A and B (and possibly C) materials, which for ease of production generally has a cylindrical or parallelepipedal shape; this latter possibility is shown in FIG. 1.

In the case of supported materials, the device may have the shape of a ring 20 as shown in FIG. 2, which represents a top plan view of the device, and in FIG. 2*a* which represents a cross-section along II—II of device 20. In this case, the device is made up of a support 21 having the shape of a toroidal channel containing the A and B (and possibly C) materials. The support is generally metallic, and preferably of nickel-plated steel.

Figure 3A:
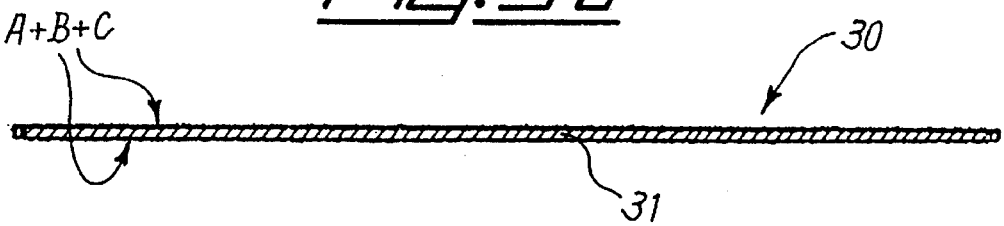
Figure 3B:
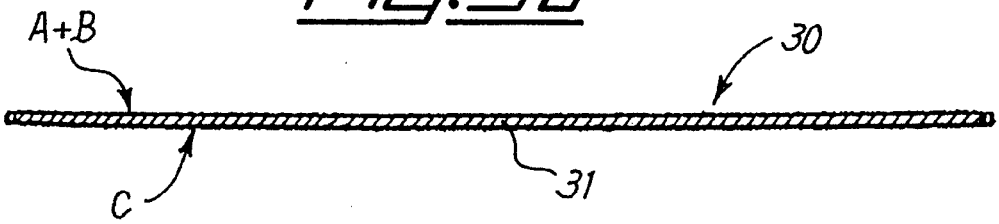

Alternatively, the device may be made in the shape of a strip 30 as shown in FIG. 3, which represents a top plan view of the device, and in FIG.3*a* and 3*b* wherein a section along III—III of device 30 is depicted. In this case, support 31 consists of a strip, preferably made of nickel-plated steel, onto which the A and B (and possibly C) materials are adhered by cold compression (rolling). In this case, whenever the presence of the getter material C is required, materials A, B and C may be mixed together and rolled on one or both faces of the strip (FIG.3*a*), but in a preferred embodiment materials A and B are placed on one surface of the strip and material C on the opposite surface, as shown in FIG. 3*b*.

The invention, in a further aspect thereof, relates to a method for introducing mercury into the electron tubes by using the above-described devices.

The method includes the step of introducing inside the tube the above-described mercury-dispensing combination of materials and preferably in one of the above-described devices 10, 20 or 30, and then the combination heating step to get mercury free. The heating step may be carried out with any suitable means such as, for example, by radiation, by high-frequency induction heating or by having a current flow through the support when the latter is made of a material having a high electric resistivity. The heating is effected at a temperature which causes the release of mercury from the mercury-dispensing combination, comprised between about 500° and about 900° C. for a time of about 10 seconds to about one minute. At temperatures lower than about 500° C. mercury is almost not dispensed at all, whereas at temperatures higher than about 900° C. there is the danger of the development of noxious gases by outgassing from the portions of the electron tube adjacent the device or the formation of metal vapors.

The invention will be further illustrated by the following examples. These non-limiting examples illustrate some embodiments intended to teach to those skilled in the art how to put in practice the invention and to show the accomplishment of the invention which is considered the best. Examples 1 to 9 concern the preparation of the releasing and promoting materials, while examples 10 to 23 concern the tests for the mercury release after the heat treatment simulating the sealing operation. All the metals used for the preparation of alloys and compounds for the following tests have a minimum pureness of 99.5%. In the compositions of the examples all percentages are on a weight basis if not differently specified.

EXAMPLE 1

This example illustrates the synthesis of the mercury-dispensing material $Ti_3Hg$.

143.7 g of titanium was placed in a steel cradle and degassed by a furnace treatment at a temperature of about 700° C. and a pressure of about $10^{-6}$ millibar (mb) for about 30 minutes. After cooling the titanium powder was placed in an inert atmosphere, 200.6 g of mercury was introduced in the cradle by means of a quartz tube. The cradle was closed and heated at about 750° C. for about 3 hours. After cooling, the product was ground until a powder capable passing through a 120 μm mesh-size standard sieve was obtained.

The resulting material essentially consists of $Ti_3Hg$, as confirmed by a diffractometric test carried out on the powder

EXAMPLES 2–10

These examples concern the preparation of the promoting alloys which make part of the combinations of the invention. The alloys were prepared by loading weighed amounts of the starting metals into alumina cradles which were then introduced in a vacuum induction furnace. The metal mixtures were heated at a temperature about 100° C. higher than the melting temperature of the corresponding alloy, kept at that temperature for 5 minutes to encourage the homogeneity thereof, and finally cast into a steel ingot-mould. Each ingot was ground in a blade mill and the resulting powder was sieved like in example 1. The respective amounts in grams of the metals used to produce the alloys are indicated in table 1. In the table, TM refers to a transition metal.

TABLE 1

| EXAMPLE N. | Cu | Sn | In | Ag | TM |
|---|---|---|---|---|---|
| 2 | 41 | 59 | 0 | 0 | 0 |
| 3 | 62 | 38 | 0 | 0 | 0 |
| 4 | 56 | 0 | 44 | 0 | 0 |
| 5 | 41 | 43 | 10 | 0 | 0 |
| 6 | 31 | 39 | 0 | 0 | 7 (Mn) |
| 7 | 31 | 39 | 0 | 0 | 7 (Ti) |
| 8 | 31 | 39 | 0 | 0 | 7 (Ni) |
| 9 | 31 | 39 | 0 | 0 | 7 (Fe) |
| 10 | 28 | 0 | 0 | 72 | 0 |

EXAMPLE 11–26

Example 11 to 26 concern the tests for mercury release from the mixtures after a heat treatment in air which simulates the conditions to which the device is subjected during the tube closing (hereafter generally referred to as sealing).

For the simulation of the sealing, 150 g of each powder mixture was loaded in a ring-shaped container that shown like in FIG. 2 and was subjected to the following thermal cycle in air:

heating from room temperature to about 400° C. in about 5 seconds;

isotherm at about 400° C. for 30 seconds;

cooling from about 400° C. to 350° C., requiring about 1 second;

isotherm at about 350° C. for about 30 seconds;

spontaneous cooling to room temperature, requiring about 2 minutes.

Thereafter, the mercury release tests were carried out on the thus treated samples by induction heating thereof at about 850° C. for about 30 seconds inside a vacuum chamber and by measuring the mercury remained in the dispensing device through the method of the complexometric titration according to Volhart.

The results of the tests are summarized in examples 17—26 of table 2, which show the mercury-dispensing compound A, the promoting material B (the combination referring to examples 2–10 is indicated in brackets), the weight ratio between components A and B and the mercury yield.

The comparative examples are marked by a star.

TABLE 2

| EXAMPLE N. | A | B | A/B | Hg |
|---|---|---|---|---|
| 11* | $Ti_3Hg$ | — | — | 35.2 |
| 12* | $Ti_3Hg$ | Cu | 5/1 | 45.7 |
| 13* | $Ti_3Hg$ | Cu | 7/3 | 34.0 |
| 14* | $Ti_3Hg$ | Sn | 5/1 | 25.0 |
| 15* | $Ti_3Hg$ | In | 5/1 | 27.0 |
| 16* | $Ti_3Hg$ | Ag | 5/1 | 49.1 |
| 17 | $Ti_3Hg$ | Cu—Sn (2) | 7/3 | 85.2 |
| 18 | $Ti_3Hg$ | Cu—Sn (2) | 1/1 | 83.6 |
| 19 | $Ti_3Hg$ | Cu—Sn (3) | 7/3 | 81.7 |
| 20 | $Ti_3Hg$ | Cu—In (4) | 7/3 | 83.4 |
| 21 | $Ti_3Hg$ | Cu—Sn—In (5) | 7/3 | 83.8 |
| 22 | $Ti_3Hg$ | Cu—Sn—Mn (6) | 7/3 | 67.8 |
| 23 | $Ti_3Hg$ | Cu—Sn—Ti (7) | 7/3 | 60.4 |
| 24 | $Ti_3Hg$ | Cu—Sn—Ni (8) | 7/3 | 64.1 |
| 25 | $Ti_3Hg$ | Cu—Sn—Fe (9) | 7/3 | 71.2 |
| 26 | $Ti_3Hg$ | Cu—Ag (10) | 7/3 | 65.3 |

It may be noted from the data of table 2 that the combinations with promoter of the present invention allow mercury yields higher than 60% during the activation step, thus permitting the reduction of the overall mercury amount introduced in the electron tubes.

Furthermore, the combinations with promoter of the present invention offer another important advantage, consisting in the possibility of carrying out the activation operation at temperatures or with times lower than those allowed by prior art materials. In fact, in order to have industrially acceptable activation times, $Ti_3Hg$ alone requires an activation temperature of about 900° C., whereas the present combinations allow the reduction of this temperature to about 850° C. for the same time, or alternatively the reduction of the operation time at the same temperature; in both cases a double advantage is achieved of causing less pollution inside the tube due to the outgassing of all the materials present therein and of reducing the amount of energy required for the activation.

All patent and non-patent references disclosed herein are incorporated by reference for all purposes.

The foregoing has been described with respect to certain disclosed embodiments and examples. However, it will be apparent to those of skill in the art the changes can be made to the embodiments and/or examples described herein without departing from the scope and/or spirit of the invention.

What is claimed is:

1. A mercury-dispensing combination comprising:

(a) a mercury dispenser including mercury and a second metal selected from the group consisting of titanium, zirconium and mixtures thereof; and (b) a promoter including copper, and a second metal selected from the group consisting of tin, indium silver and combinations thereof.

2. A mercury-dispensing combination according to claim 1, wherein said promoter includes copper, a second metal selected from the group consisting of tin, indium and combinations thereof, and a transition metal, wherein said transition metal is present in an amount not greater than about 10% of the overall weight of said promoter.

3. A mercury-dispensing combination according to claim 1, wherein said mercury dispenser is $Ti_3Hg$.

4. A mercury dispensing combination according to claim 1, wherein said promoter is a Cu—Sn alloy containing from about 3% to about 63% of Cu on a weight basis.

5. A mercury-dispensing combination according to claim 4, wherein said promoter is the non-stoichiometric phase $Cu_6Sn_5$.

6. A mercury-dispensing combination according to claim 1, wherein said promoter is a Cu—In alloy containing from about 40% to about 60% of Cu on a weight basis.

7. A mercury-dispensing combination according to claim 6, wherein said promoter is a Cu—In alloy containing about 44% of Cu on a weight basis.

8. A mercury-dispensing combination according to claim 1, wherein said promoter is a Cu—Ag alloy containing from about 10% to about 80% of Cu on a weight basis.

9. A mercury-dispensing combination according to claim 1, wherein the weight ratio of said mercury dispenser ranges from about 20:1 to about 1:20.

10. A mercury-dispensing combination according to claim 9, wherein the weight ratio between and said promoter ranges from about 10:1 to about 1:5.

11. A mercury-dispensing device comprising the mercury dispenser and promoter of claim 1.

12. A mercury-dispensing device according to claim 11 further containing a getter material.

13. A mercury-dispensing device according to claim 12, wherein said getter material is selected from the group consisting of the metals titanium, zirconium, tantalum, niobium, vanadium and mixtures thereof, and alloys of said metals with nickel, iron or aluminum.

14. A mercury-dispensing device according to claim 13, wherein said mercury dispenser is $Ti_3Hg$, said promoter is the non-stoichiometric phase $Cu_6Sn_5$ and said getter material is an alloy having the composition Zr 84%–Al 16% on a weight basis.

15. A mercury-dispensing device according to claim 12, wherein said mercury dispenser, said promoter and said getter material are in the form of a powder.

16. A mercury-dispensing device according to claim 15, consisting of a tablet of compressed powders of said mercury dispenser, said promoter and said getter material.

17. A mercury-dispensing device according to claim 15, wherein said mercury dispenser, said promoter and said getter material are contained in a metallic support having a ring shape.

18. A mercury-dispensing device according to claim 15, wherein the combination of said mercury dispenser, said promoter and said setter material is rolled on the surface of a support having the shape of a strip, and said getter material is rolled on the opposite surface of the same strip.

19. A mercury-dispensing device according to claim 12, wherein the ratio between the overall weight of said mercury dispenser and said promoter and the weight of said getter material is between about 10:1 and about 1:10.

20. A mercury-dispensing device according to claim 19, wherein the ratio between the overall weight of said mercury dispenser and said promoter and the weight of said getter material is between about 2:1 and about 1:5.

21. A mercury-dispensing device according to claim 12, wherein said mercury dispenser, said promoter and said getter material are in the form of powders having a particle size lower than about 250 μm.

22. A mercury-dispensing device according to claim 12, wherein said mercury dispenser, said promoter and said getter material are in the form of powders having a particle sizes between about 10 μm and about 125 μm.

23. A process for introducing mercury inside electron tubes, comprising the steps of introducing into an electron tube a mercury-dispensing device of claims 11 to 22, and heating said device to at a temperature between about 550° C. and about 900° C. for a time between about 10 seconds and about one minute after sealing said electon tube to produce thereby free mercury in said electron tube.

24. A process according to claim 23, wherein said electron tube is a fluorescent lamp.

* * * * *